United States Patent [19]

Krempelmeier

[11] Patent Number: 4,579,369

[45] Date of Patent: Apr. 1, 1986

[54] PRINTED MATTER, PARTICULARLY NEWSPAPER

[76] Inventor: Franz Krempelmeier, Vöcklastrasse 4, Vöcklamarkt, Austria

[21] Appl. No.: 567,857

[22] PCT Filed: Apr. 22, 1983

[86] PCT No.: PCT/AT83/00011

§ 371 Date: Dec. 12, 1983

§ 102(e) Date: Dec. 12, 1983

[87] PCT Pub. No.: WO83/03799

PCT Pub. Date: Nov. 10, 1983

[30] Foreign Application Priority Data

Apr. 22, 1982 [AT] Austria ..... 1571/82

[51] Int. Cl.[4] ..... B42D 7/00

[52] U.S. Cl. ..... 281/2; 281/40

[58] Field of Search ..... 281/2, 5, 21 R, 41, 281/40

[56] References Cited

U.S. PATENT DOCUMENTS 2,011,572 8/1935 Eiseman ..... 281/5

3,995,886 12/1976 Staats ..... 281/21 R X

FOREIGN PATENT DOCUMENTS 1263413 5/1961 France .

2353402 12/1977 France .

2072096 9/1981 United Kingdom .

*Primary Examiner*—Paul A. Bell

*Attorney, Agent, or Firm*—Kurt Kelman

[57] ABSTRACT

Printed matter consists of folded sheets (1) of paper, each of which has a crease (2) and a prepared fold line (3), which is associated with and parallel to that crease (2) and permits of a backfolding in order to facilitate the manipulation.

2 Claims, 2 Drawing Figures

PRINTED MATTER, PARTICULARLY NEWSPAPER

Figure 1:
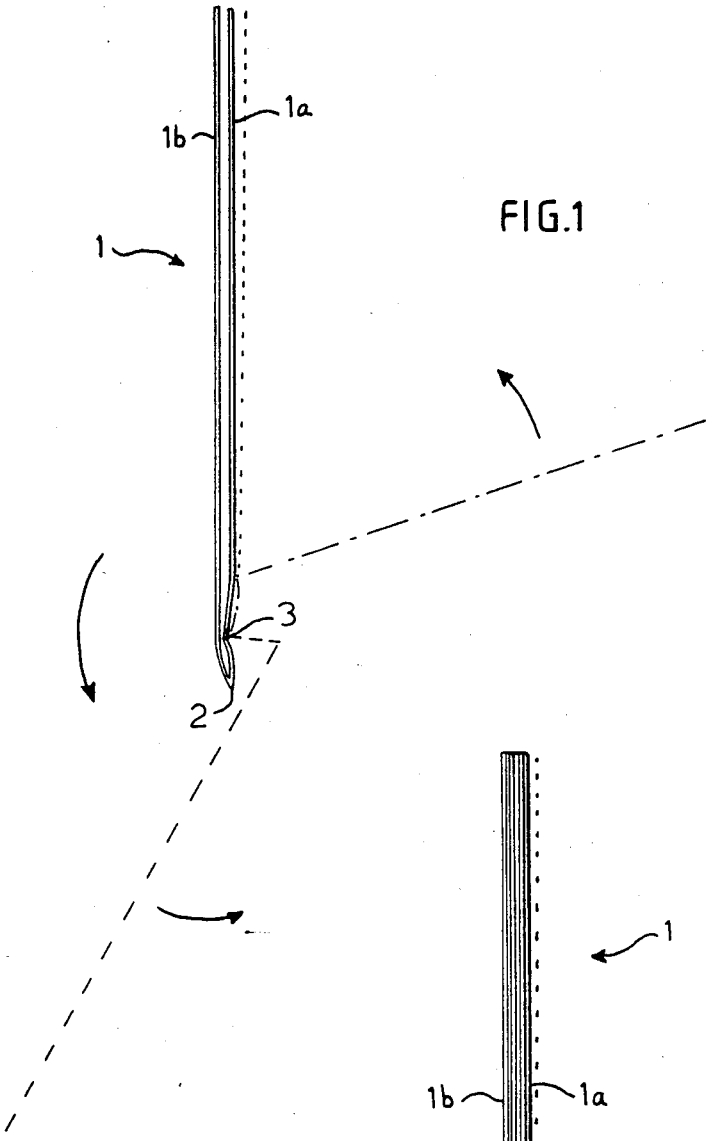

This invention relates to printed matter consisting of at least one folded sheet of paper or the like, particularly to a newspaper.

A sheet of paper which has been folded once can be printed or used to carry information on four sides. To permit a reading of printed matter consisting of such folded sheets of paper, the sheets must be unfolded and the consecutive top leaves formed by the folded sheet must be turned over. Because such printed matter is usually larger in size than a book, the leaves are often turned over, and this is frequently necessary when a person is reading a newspaper in vehicles for public transportation, in cafés or in other confined places. It is difficult to turn the leaves of a newspaper of similar printed matter over if the leaves have a large size. This difficulty is due to the fact that the creases formed by the center folds of the sheets of paper will oppose the opening of the leaves and the turning of the leaves through more than 180° and will promote the formation of transverse wrinkles or the like so that a convenient unfolding and turning over by a single movement is prevented and highly complicated manipulations are required for the desired turning over of the leaves of the printed matter. These manipulations annoy the reader and all persons in his or her neighborhood.

French Pat. Nos. 2,353,402 and 1,263,413 disclose covers for notepads or the like. By means of prepared fold lines in the back of the cover, these covers are divided into a plurality of hingedly connected portions. These covers are intended to permit the pad to be unfolded. For that purpose a back having a certain width is required and this structure cannot be applied to folded sheets of paper. In U.S. Pat. No. 835,887 it has been proposed to provide single sheets with a plurality of fold lines having the same orientation so that relatively thick printed matter can be unfolded in a flat form. But that does not facilitate the turning over of a folded sheet of paper through 360°.

It is an object of the invention to provide very simple means by which printed matter of the kind described first hereinbefore is improved so that it can be conveniently handled for being read and particularly can be turned over by a single manipulation.

This object is accomplished according to the invention in that the crease formed by folding the sheet has associated with it a prepared fold line, which is parallel to the crease and permits of a backfolding adjacent to the crease. Such fold line can be provided during the manufacture of the printed matter without a high expenditure, e.g., by impressing the fold lines into the sheets of paper. The fold line in combination with the crease constitutes a hinge, which has a stiffening action and permits a turning of the leaves through more than 180° without any difficulty and regardless of whether one or more sheets are present and whether folded sheets are loosely inserted into each other or have been bound together.

If, in accordance with the invention, each fold line is provided on the bottom one of the two leaves which are separated by the crease, turning a leaf over, particularly when a relatively large number of sheets of paper have been inserted into each other, will be further facilitated because the leaves being turned over are swung down so that they are disengaged from the creases of the remaining sheets and need not be turned about these creases.

Figure 2:
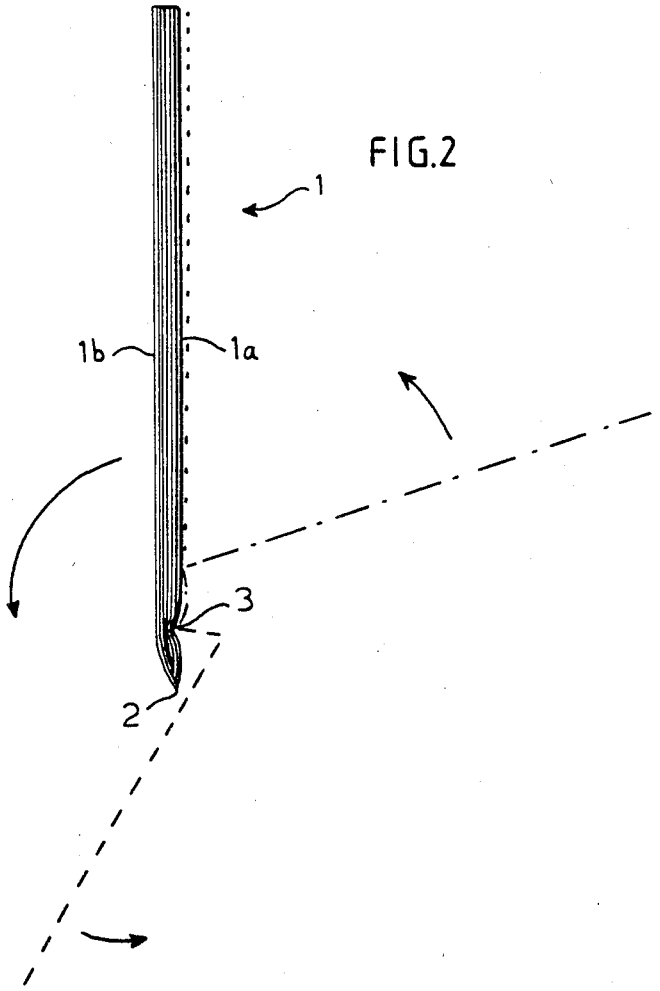

In the drawings, wherein similar reference characters denote similar elements throughout the several views:

FIG. 1 is a diagrammatic sectional view of a single sheet of printed matter according to the present invention; and FIG. 2 is a diagrammatic sectional view of a multiplicity of folded associated sheets, as shown in FIG. 1.

In order to facilitate the turning open and turning over of sheets 1 of paper which have been folded once at center crease 2, a fold line 3 for backfolding is prepared adjacent to the crease 2. That fold line 3 is provided in the bottom leaf 1*a* of the sheet 1, which has been divided into two leaves by the crease. The crease 2 and the fold line 3 virtually constitute a hinge, which permits the top leaf 1*b* to be turned over downwardly through 360° . As that leaf 1*b* is unfolded (as indicated by broken lines), the crease 2 opens and the folding around the prepared fold line 3 is initiated. As the leaf 1*b* is turned over through more than 180° the trend to a folding around the fold line 3 is continued and the stiffening provided by the crease 2 exerts a favorable influence (illustration in dash-dot lines). When that folding operation has been terminated, the original crease 2 is extended so that the leaf 1*b* is turned over through 360° in an entirely satisfactory manner (illustration in dotted lines), and the sheet 1 has then been folded around the fold line 3 whereas the crease 2 has been opened.

FIG. 2 shows a multiplicity of sheets which have been inserted into each other. The simple measure of providing a prepared additional fold line fo backfolding also greatly facilitates the handling of printed matter comprising a plurality of folded sheets of paper, which have been inserted into each other or are bound together, and which may be of any desired size, and permits the leaves to be turned over in a single manipulation.

I claim:

1. A multiplicity of associated folded sheets of paper, each of said sheets of paper carrying printed matter and folded along a center crease forming a top leaf and a bottom leaf, said sheets being nested one within another such that said center creases of said sheets are adjacent to each other, said bottom leaf of each of said sheets having a fold line adjacent the center crease and extending parallel thereto, the fold line being so closely adjacent the center crease that it constitutes a hinge with the crease line and permits said top leaves of said sheets to be turned around the fold line through 360°.

2. The sheet of paper of claim 1, wherein the one leaf is the bottom leaf.

* * * * *